US008622574B2

(12) United States Patent
Liu

(10) Patent No.: US 8,622,574 B2
(45) Date of Patent: Jan. 7, 2014

(54) LED LAMP HAVING LIGHT EMITTING DIODES WITH REDUCED NUMBER OF LENSES COVERED THEREON

(75) Inventor: You-Xue Liu, Shenzhen (CN)

(73) Assignees: Fu Zhun Precision Industry (Shen Zhen) Co., Ltd., Shenzhen (CN); Foxconn Technology Co., Ltd., New Taipei (TW)

( * ) Notice: Subject to any disclaimer, the term of this patent is extended or adjusted under 35 U.S.C. 154(b) by 306 days.

(21) Appl. No.: 13/108,993

(22) Filed: May 17, 2011

(65) Prior Publication Data

US 2012/0087125 A1 Apr. 12, 2012

(30) Foreign Application Priority Data

Oct. 7, 2010 (CN) ..... 2010 1 0299052

(51) Int. Cl.
*F21V 21/005* (2006.01)

(52) U.S. Cl.
USPC ..... 362/241; 362/249.02; 362/249.06; 362/294

(58) Field of Classification Search
USPC ..... 362/249.02, 249.1, 249.11, 800, 294, 362/373, 241
See application file for complete search history.

(56) References Cited

U.S. PATENT DOCUMENTS

| | | | | |
|---|---|---|---|---|
| 6,598,994 | B1 * | 7/2003 | Tait et al. | 362/11 |
| 7,922,372 | B2 * | 4/2011 | Li | 362/373 |
| 7,959,327 | B2 * | 6/2011 | Lai et al. | 362/294 |
| 8,220,971 | B2 * | 7/2012 | Harbers et al. | 362/294 |
| 8,419,224 | B2 * | 4/2013 | Wan-Chih et al. | 362/294 |
| 2004/0202007 | A1 * | 10/2004 | Yagi et al. | 362/545 |
| 2009/0244894 | A1 * | 10/2009 | Zhou et al. | 362/249.02 |
| 2011/0194285 | A1 * | 8/2011 | Harbers et al. | 362/249.02 |

* cited by examiner

*Primary Examiner* — Anabel Ton
(74) *Attorney, Agent, or Firm* — Altis Law Group, Inc.

(57) ABSTRACT

A light emitting diode (LED) lamp includes a light emitting module; a power module for driving the light emitting module; and a housing having an optical part for receiving the light emitting module, an electrical part for receiving the power module. The light emitting module includes a plurality of circuit boards sequentially arranged parallel to each other, a plurality of first LED chips which has lenses covered thereon being mounted on the circuit boards, and a plurality of second LED chips which has no lens covered thereon being mounted also on the circuit boards. The first and the second LED chips are arranged in columns and rows. The second LED chips are located symmetrically in respect to the first LED chips.

18 Claims, 5 Drawing Sheets

LED LAMP HAVING LIGHT EMITTING DIODES WITH REDUCED NUMBER OF LENSES COVERED THEREON

BACKGROUND

1. Technical Field

The present disclosure relates to a light emitting diode (LED) lamp, and more particularly, to an LED lamp having a plurality of LED chips wherein some of the LED chips are without lens covered thereon.

2. Description of Related Art

The LED lamps have been more and more widely used around the world recently. A typical LED lamp includes a plurality of LED chips and a plurality of lenses correspondingly covering each light emitting diode to obtain a special light distribution curve. However, the lenses covering the light emitting diodes block the light transmission to some degree thereby lowering the efficiency of use of light generated by LED chips of the LED lamp.

Therefore, a new LED lamp is desired to overcome the above-described shortcomings.

BRIEF DESCRIPTION OF THE DRAWINGS

The components in the drawings are not necessarily drawn to scale, the emphasis instead being placed upon clearly illustrating the principles of at least one embodiment. In the drawings, like reference numerals designate corresponding parts throughout the various views.

DETAILED DESCRIPTION

Reference will now be made to the drawings to describe various inventive embodiments of the present disclosure in detail, wherein like numerals refer to like units throughout.

Figure 1:
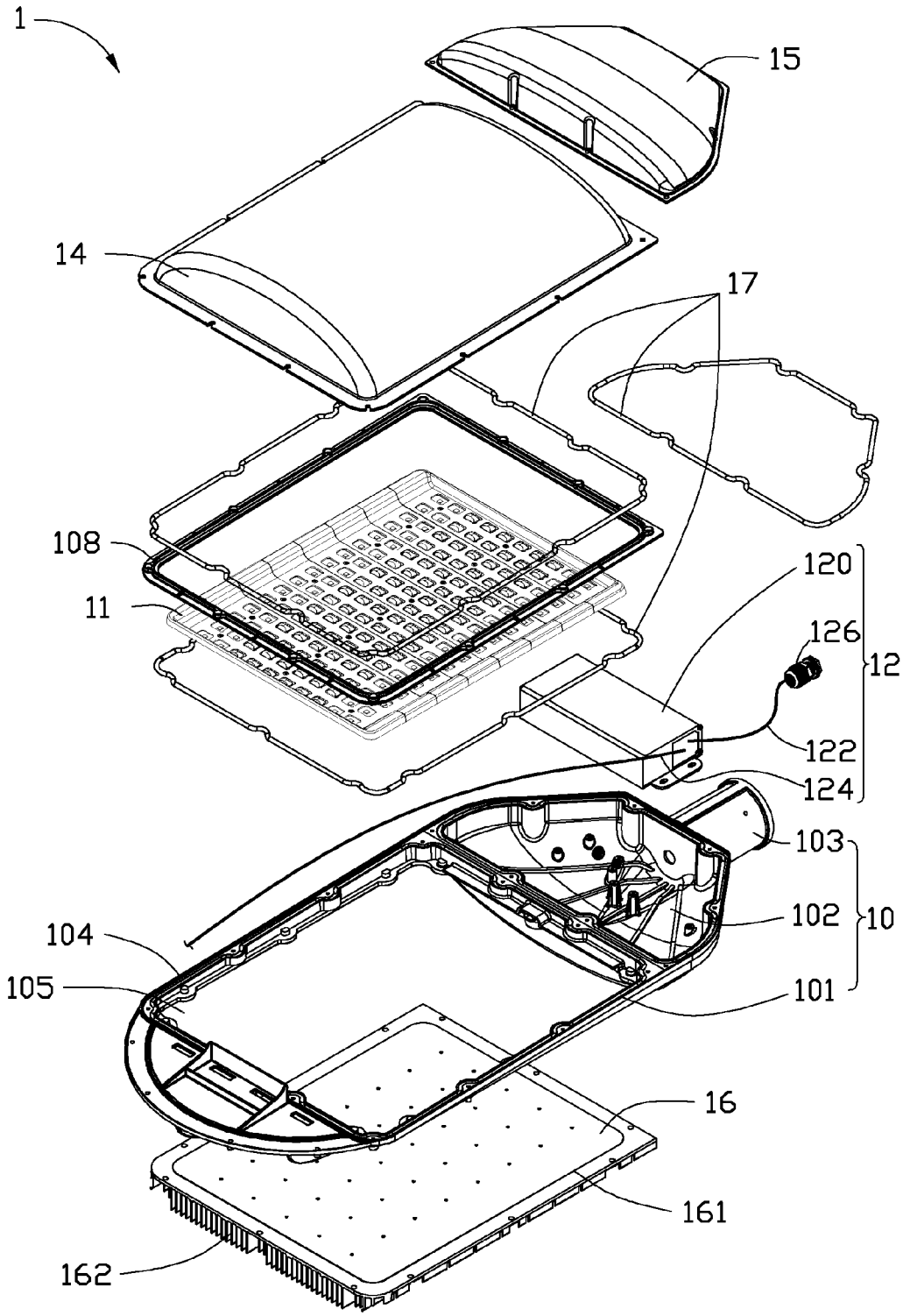
FIG. 1 is a schematic, isometric view of an LED lamp according to a first embodiment of the present disclosure.
Figure 2:
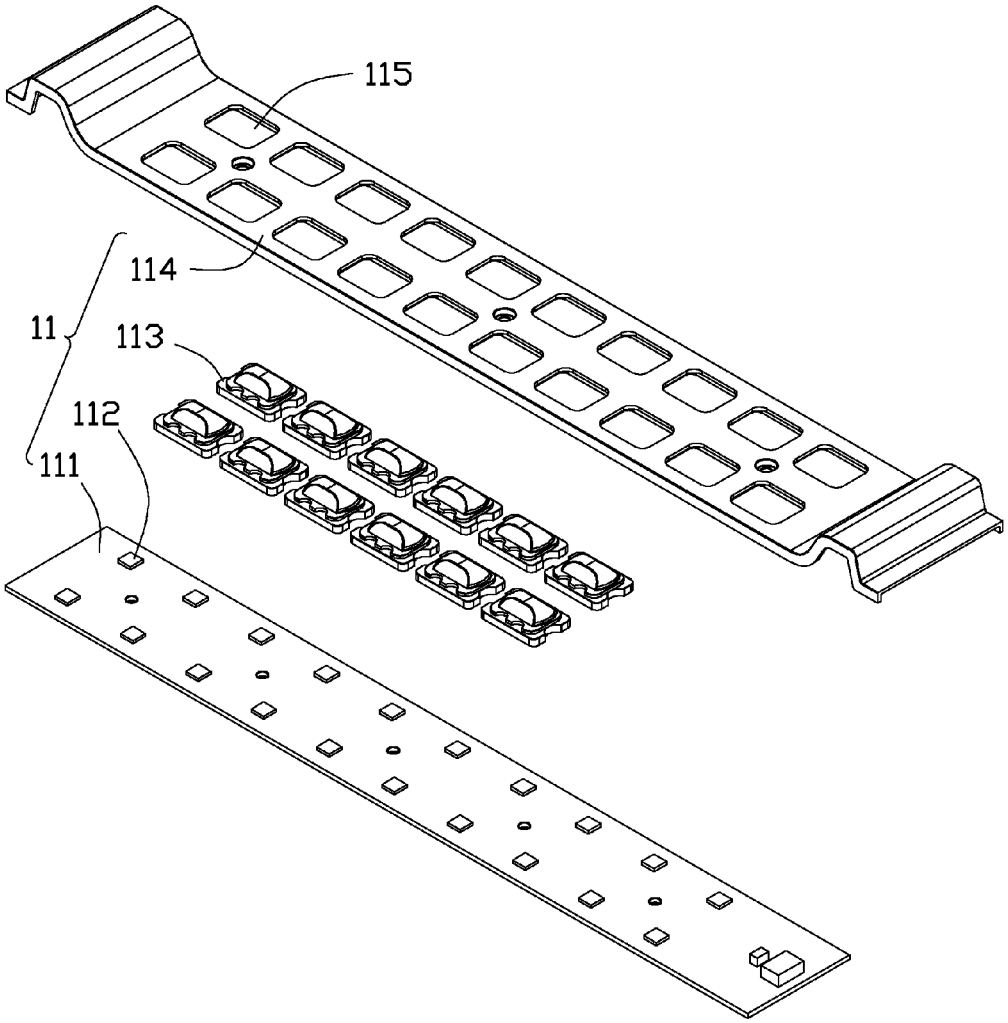
FIG. 2 is a schematic, enlarged, exploded, partial view of the LED lamp of FIG. 1.

Referring to FIG. 1 and FIG. 2, an LED lamp 1 according to a first embodiment of the present invention includes a housing 10, a light emitting module 11, a power supply module 12 for driving the light emitting module 11, a plurality of reflectors 114, a transparent cap 14, a cover 15, a heat sink 16, and a plurality of ring-shaped sealants 17.

The power supply module 12 includes a transformer 120, a first wire 122, a second wire 124, and a connector 126 connected to the transformer 120 via the first wire 122. The transformer 120 is configured for receiving an external power supply via the connector 126 and configured for converting an alternating current (AC) power into a direct current (DC) power with a required operation voltage for driving the light emitting module 11 to generate light.

The housing 10 includes an optical part 101, an electric part 102, and a lamp head 103. The optical part 101 includes a frame 104 which defines a space 105 for receiving the light emitting module 11.

The electric part 102 is located adjacent to the optical part 101 and the lamp head 103 and sandwiched therebetween. The electric part 102 is configured for receiving the transformer 120. The lamp head 103 is configured for receiving the first wire 122 and the connector 126. In this embodiment, the lamp head 103 is hollow column. One terminal of the lamp head 103 communicates with the electric part 102 and the other terminal of the lamp head 103 connects to a mounting device, such as a pole of a street lamp (not shown).

The second wire 124 is extended from the transformer 120 and arranged along the frame 104 to surround the space 105 for providing the operation voltage to the light emitting module 11. The second wire 124 is electrically connected with the light emitting module 11.

The light emitting module 11 includes a plurality of circuit boards 111 sequentially arranged parallel to each other, a plurality of LED chips 112, a plurality of lens 113, and the plurality of reflectors 114. In this embodiment, the circuit boards 111 are rectangular and received in the space 105. Two ends of each circuit board 111 are fixed to opposite sides of the frame 104 and electrically connected to the transformer 120 via the second wire 124 for receiving the operation voltage.

The LED chips 112 are mounted on the circuit boards 111 in columns and rows. Some of the LED chips 112 have lenses 113 covered thereon while some of the other LED chips 112 have no lens covered thereon. That is, the lenses 113 cover only a part of the LED chips 112 to generate a predetermined light distribution curve for the LED lamp 1. For convenience of description, the LED chips 112 with lenses 113 covered thereon are defined as first LED chips and the LED chips 112 without lens covered thereon are defined as second LED chips. In one embodiment, each circuit board 111 includes two rows of LED chips 112. Each row of LED chips 112 includes ten LED chips 112. Six middle ones of the ten LED chips 112 function as the first LED chips and four LED chips 112 located beside the six middle ones function as the second LED chips. More specifically, two second LED chips are located at one side of the six first LED chips and the other two second LED chips are located at an opposite side of the six first LED chips. That is, the second LED chips are arranged symmetrically at two opposite sides of the first LED chips.

Each reflector 114 covers one corresponding circuit board 111 and includes a plurality of through holes 115 for exposing the LEDs 112 and the corresponding lenses 113 covering the first LEDs. In other words, the through holes 115 of the reflectors 114 are configured for exposing both the first LED chips and the second LED chips.

The transparent cap 14 is arc-shaped and covers one side of the optical part 101 for protecting the light emitting module 11. In this embodiment, a fixing ring 108 is further provided between the transparent cap 14 and the frame 104 for more securely and hermetically connecting the cap 14 to the frame 104. One sealant 17 is sandwiched between the transparent cap 14 and the fixing ring 108 and another sealant 17 is sandwiched between the frame 104 and the fixing ring 108, whereby the space 105 and the light emitting module 11 received in the space is protected from moisture and dust.

In an alternative embodiment, the fixing ring 108 can be omitted and the transparent cap 14 is mounted to the optical part 101 with a sealant 17 sandwiched therebetween.

The cover 15 covers the electric part 102 with another sealant 17 sandwiched therebetween, whereby the transformer 20 received in the electric part 102 is protected from moisture and dust.

Figure 3:
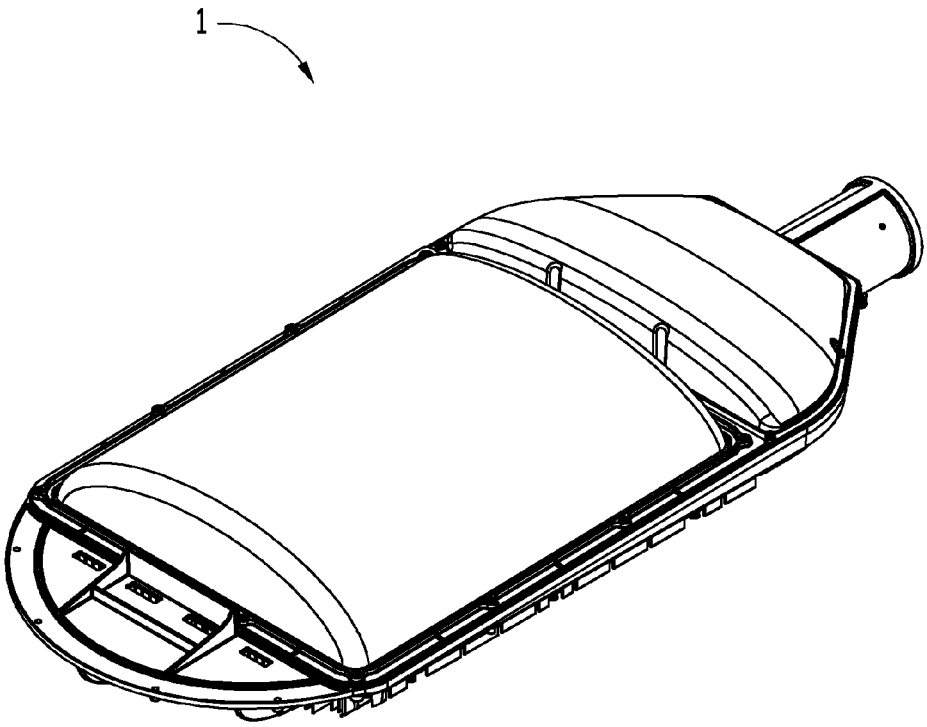
FIG. 3 is a schematic, isometric assembly of the LED lamp of FIG. 1.

The heat sink 16 is attached to the other side of the optical part 101 and in thermal and mechanical connection with the light emitting module 11. The heat sink 16 includes a heat dissipating substrate 161 and a plurality of fins 162 formed on a bottom surface of the dissipating substrate 161 as shown in FIG. 1. In this embodiment, edge of the dissipating substrate 161 is fixed to the frame 104, and the circuit boards 111 are secured on a top surface of the dissipating substrate 161 via a plurality of screws (not shown) whereby heat generated by the LED chips 112 can be effectively transferred to the heat sink 16 and dissipated to surrounding air by the fins 162. In this embodiment, the fins 162 are spaced from each other and perpendicularly extended from a bottom surface of the dissipating substrate 161. In one embodiment, a heat conductive material such as silicone grease is smashed on the top surface of the dissipating substrate 161 to improve a heat transfer from the LED chips 112 to the heat sink 16. An assembly of the LED lamp 1 is shown in FIG. 3.

Because only a part of the LED chips 112 is covered with the lenses 113 and the other part of LED chips 112 without lens covered thereon is symmetrically arranged in respect to the part, both brightness and light distribution curve of the LED lamp 1 are improved.

Figure 4:
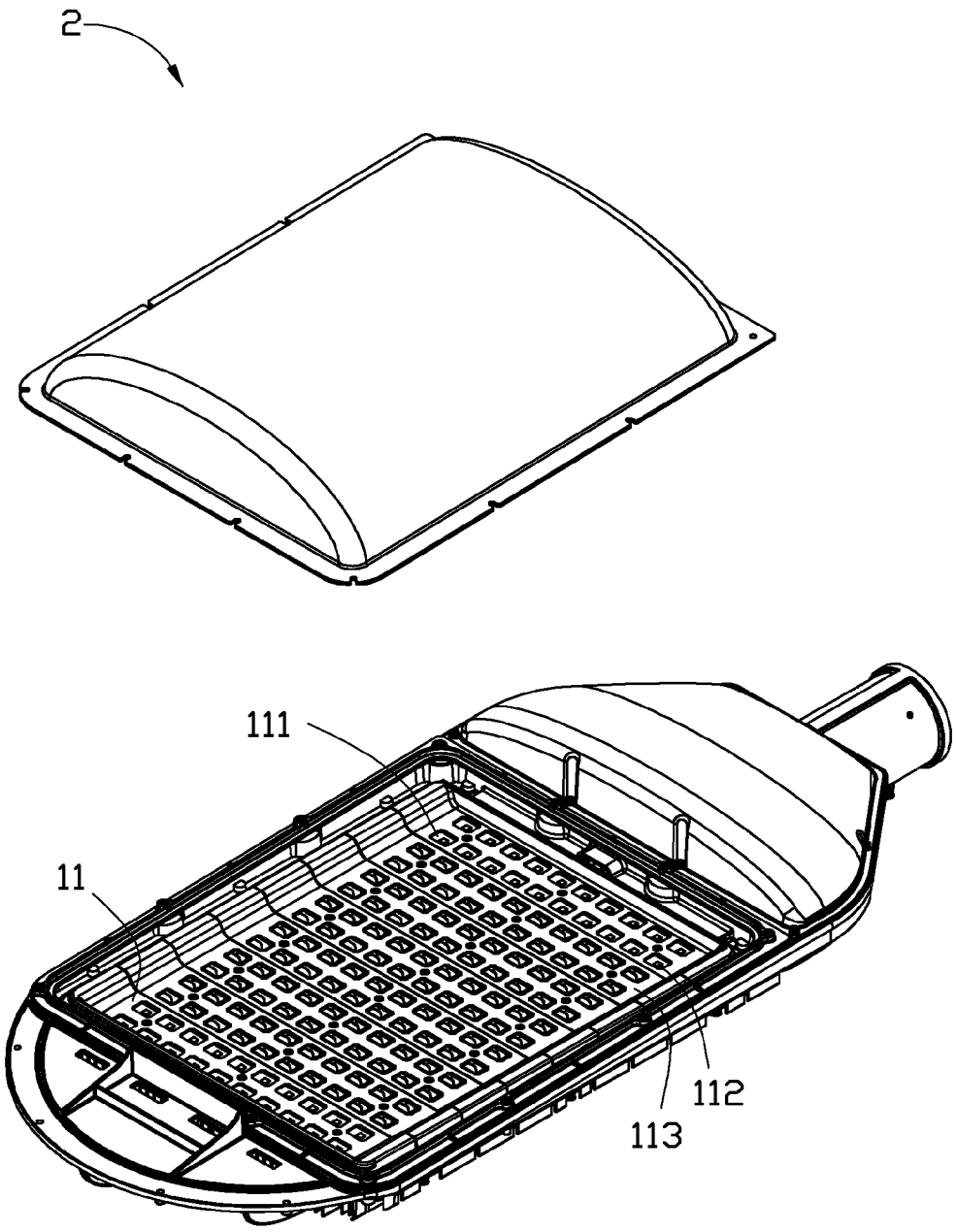
FIG. 4 is a schematic, isometric view of an LED lamp according to a second embodiment of the present disclosure.

Referring to FIG. 4, an LED lamp 2 according to a second embodiment of the present disclosure is similar to the LED lamp 1 of the first embodiment. The LED lamp 2 is only different from the LED lamp 1 in that the light emitting module 11 includes a plurality of circuit boards 111 sequentially arranged parallel to each other as shown in FIG. 4. All of the LED chips 112 on the circuit board 111 have lenses 113 covered thereon except the LED chips 112 on the two outermost circuit boards 111. In other words, the second LED chips are only on the two outermost circuit boards 111 while the first LED chips are on the other circuit boards 111 that are sandwiched between the two outermost circuit boards 111.

Figure 5:
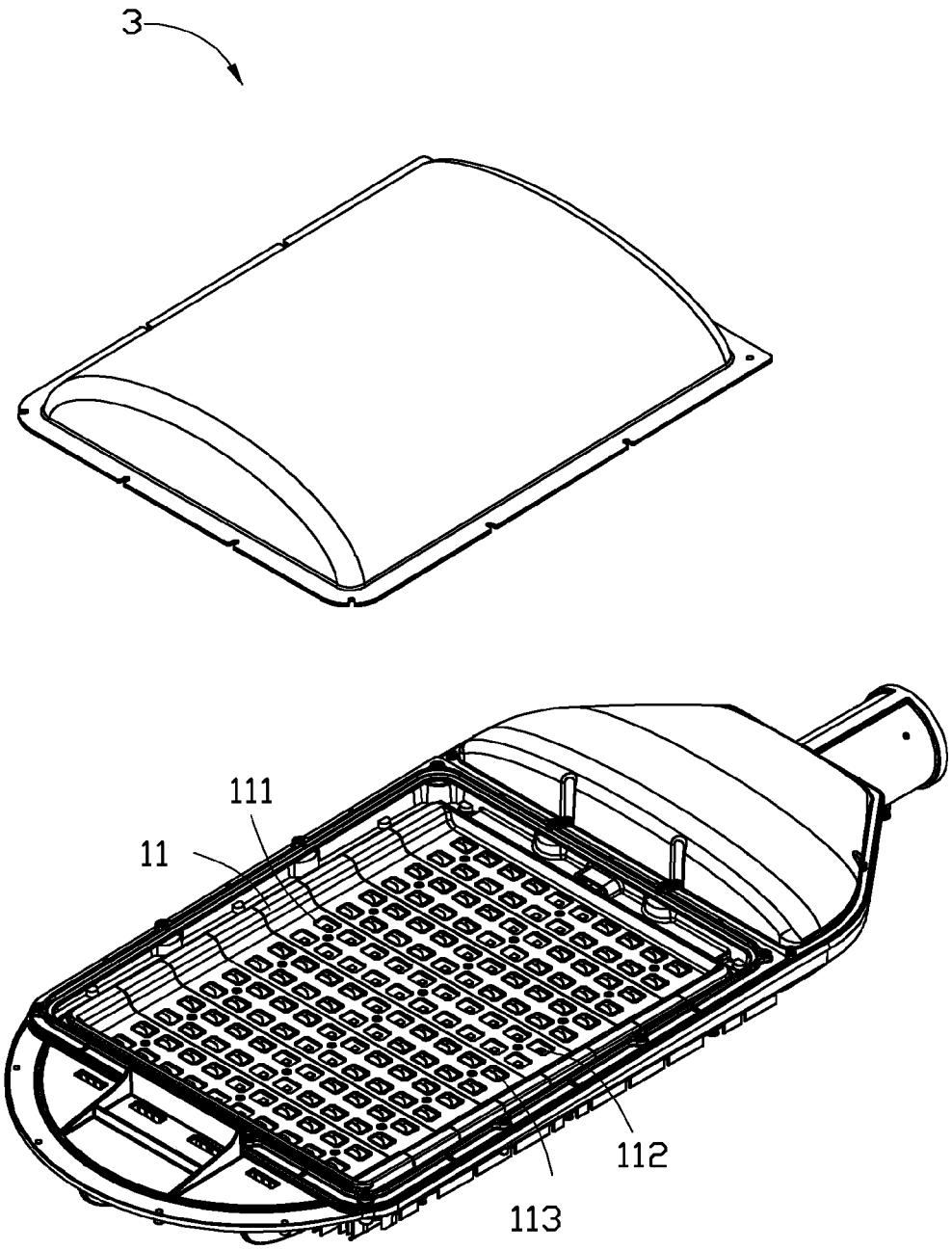
FIG. 5 is a schematic, isometric view of an LED lamp according to a third embodiment of the present disclosure.

Referring to FIG. 5, an LED lamp 3 according to a third embodiment of the present disclosure is similar to the LED lamp 1 of the first embodiment. The LED lamp 3 is only different from the LED lamp 1 in that the light emitting module 11 includes a plurality of circuit boards 111 sequentially arranged parallel to each other as shown in FIG. 5 and the second LED chips are cross-shaped. In this embodiment, a central circuit board 111 includes two rows of LED chips 112 without lenses 113 covered thereon. Each of the other circuit boards 112 includes two rows of LED chips 112 in which middle fours of the LED chips 112 are without lens covered thereon.

In alternative embodiment, the LED chips 112 of the LED lamp 3 without lens covered thereon can be arranged in other patterns, i.e., capital letters or symbols, such as such as H、I、O、X、θ, according to the actual requirement.

It is to be understood, however, that even though numerous characteristics and advantages of certain inventive embodiments have been set out in the foregoing description, together with details of the structures and functions of the embodiments, the disclosure is illustrative only; and that changes may be made in detail, especially in matters of arrangement of parts within the principles of present invention to the full extent indicated by the broad general meaning of the terms in which the appended claims are expressed.

What is claimed is:

1. A light emitting diode (LED) lamp comprising:

a light emitting module comprising a plurality of circuit boards sequentially arranged parallel to each other;

a plurality of first LED chips on the circuit boards which are cover by lenses; and a plurality of second LED chips on the circuit boards which are without lens covered thereon;

a power module for providing a driving power to the light emitting module; and a housing comprising an optical part for receiving the light emitting module therein, and an electrical part for receiving the power module therein;

wherein the first and the second LED chips are arranged in columns and rows, and the second LED chips are arranged symmetrically in respect to the first LED chips.

2. The LED lamp of claim 1, wherein the second LED chips are arranged at opposite sides of the first LED chips.

3. The LED lamp of claim 2, wherein the first LED chips are formed on each circuit board in two rows, and the second LED chips are positioned at two opposite sides of the first LED chips on each circuit board.

4. The LED lamp of claim 2, wherein the second LED chips are only on two outermost circuit boards and the first LED chips are only on the other circuit board that are sandwiched between the two outermost circuit boards.

5. The LED lamp of claim 1, wherein the second LED chips are cross-shaped.

6. The LED lamp of claim 1, wherein the second LED chips are symmetrically arranged in a pattern of a capital letter.

7. The LED lamp of claim 1, further comprising a transparent cap fixed to the housing and covering the optical part for protecting the light emitting module.

8. The LED lamp of claim 7, further comprising a ring-shaped sealant sandwiched between the transparent cap and the optical part.

9. The LED lamp of claim 1, further comprising a heat sink fixed to the housing at a position opposite to the transparent cap, wherein the heat sink comprises a heat dissipating substrate and a plurality of fins spaced from each other formed on a bottom surface of the heat dissipating substrate, and a top surface of the heat dissipating substrate is in thermal and mechanical connection with the circuit boards.

10. The LED lamp of claim 9, further comprising conductive silicon grease smashed on the top surface of the dissipating substrate.

11. The LED lamp of claim 1, further comprising a plurality of reflectors each covering one circuit board and comprising a plurality of through holes to expose the first and the second LED chips.

12. The LED lamp of claim 1, wherein the optical part comprises a frame defining a space therein for receiving the light emitting module.

13. The LED lamp of claim 12, wherein the power supply module comprises a transformer, a first wire, and a connector connected to the transformer via the first wire.

14. The LED lamp of claim 13, wherein the housing further comprise a lamp head configured for receiving the first wire and the connector therein, wherein one terminal of the lamp head communicates with the electric part and the other terminal of the lamp head connects to a mounting device.

15. The LED lamp of claim 14, wherein the connector and the first wire are adapted for electrically connecting with an external power source.

16. The LED lamp of claim 13, wherein the power supply module further comprises a second wire extending from the transformer and arranged around the frame for providing an operation voltage to the light emitting module.

17. The LED lamp of claim 16, wherein each of the circuit boards is rectangular and electrically connected to the transformer via the second wire for receiving the operation voltage.

18. The LED lamp of claim 7, further comprising a fixing ring sandwiched between the optical part of the housing and the transparent cap for securely mounting transparent cap to the housing.

* * * * *